US007415930B2

(12) United States Patent
Raphelt et al.

(10) Patent No.: US 7,415,930 B2
(45) Date of Patent: Aug. 26, 2008

(54) SEEKING FUSED MUNITION

(75) Inventors: Michael Raphelt, Lauf (DE); Günther Thurner, Schwaig (DE); Armin Hofmockel, Nürnberg (DE); Otto Schäfer, Röthenbach (DE); Wilhelm Fürst, Sengenthal (DE)

(73) Assignee: Diehl BGT Defence GmbH & Co., KG, Uberlingen (DE)

( * ) Notice: Subject to any disclaimer, the term of this patent is extended or adjusted under 35 U.S.C. 154(b) by 33 days.

(21) Appl. No.: 11/516,863

(22) Filed: Sep. 7, 2006

(65) Prior Publication Data

US 2007/0107619 A1 May 17, 2007

(30) Foreign Application Priority Data

Sep. 10, 2005 (DE) ..... 10 2005 043 078

(51) Int. Cl.
*F42B 10/06* (2006.01)
*F42B 10/14* (2006.01)
*F42B 10/48* (2006.01)

(52) U.S. Cl. ..... 102/475; 102/477; 244/3.25

(58) Field of Classification Search ..... 102/475, 102/476, 377, 378, 490; 244/3.3, 3.24, 3.25
See application file for complete search history.

(56) References Cited

U.S. PATENT DOCUMENTS

| | | | | |
|---|---|---|---|---|
| 4,597,333 | A | 7/1986 | Bocker et al. | |
| 4,823,700 | A | 4/1989 | Alker et al. | |
| 5,370,057 | A | 12/1994 | Badura et al. | |
| 6,216,597 | B1 * | 4/2001 | Bredy | 102/476 |

FOREIGN PATENT DOCUMENTS

| | | |
|---|---|---|
| CH | 81 919 A | 8/1918 |
| FR | 2 545 923 A1 | 5/1984 |

* cited by examiner

*Primary Examiner*—James S Bergin
(74) *Attorney, Agent, or Firm*—Scully, Scott, Murphy & Presser, P.C.

(57) ABSTRACT

A seeking fused munition (10), which at the front end thereof, has a projectile-forming insert (12). In order to define an optimally effective projectile-forming insert (12), even in a configuration of relatively small caliber, the seeking fused munition (10) is of a full-caliber configuration without a casing. A tail portion (24) is provided at the rear end of the seeking fused munition (10). The tail portion (24) is connected to the seeking fused munition (10) along a peripherally extending specified rupture portion (26).

5 Claims, 1 Drawing Sheet

SEEKING FUSED MUNITION

BACKGROUND OF THE INVENTION

1. Field of the Invention

The invention concerns a seeking fused munition, which has a projectile-forming insert at the front end thereof.

2. Discussion of the Prior Art

A seeking fused munition and a method of combating armored target objects by means of such a terminal phase-correctable seeking fused munition is known from German Patent Application No. DE 35 16 673 C2. That known seeking fused munition has a parachute and is characterised in that it is provided with devices for nullifying or restoring the effect of the parachute and at least one pulse generator for initiating a quasi-ballistic trajectory from a dropping phase which is braked by the parachute.

German Patent Application No. DE 41 04 800 C2 describes a device for real-time terrain reconnaissance by means of at least one sensor which can be launched as a payload by a carrier projectile in the manner of a submunition and the information of which can be transmitted by way of a relay to a remote receiving station, wherein each sensor and the relay are in the form of payloads, equipped with descent braking means, of an artillery carrier projectile, which after launch over a target area to be verified can be released from the carrier projectile. The relay is equipped with a braking means to afford a substantially lower descent rate than the sensor which senses on a rotating path and in so doing narrows down the target area in a spiral form.

German Patent Application No. DE 44 26 014 A1 discloses a system for protecting a target such as an armored vehicle, a bunker or the like from shells having a launch container mounted adjustably movably on a base portion, with at least one launch barrel for an associated fragmentation grenade, a sensor device for detecting the target to be combated and directing the launch container towards the target to be combated, and a drive device which is connected together with the sensor device by way of a signal processing device and a control device for orienting the launch container relative to the base portion, wherein the at least one fragmentation grenade is provided with a fragmentation cover and a fuse device for controlling the firing time. That arrangement can have an explosive device with a hollow charge.

A reconnaissance device with a sensor unit for detecting and locating targets which can be transported together with a deployable, descent-retarding device in an artillery shell and which can be released therefrom and which is provided with a braking parachute and an anti-spin device is known from German Patent Application No. DE 196 13 492 C2.

A seeking fused munition for artillery of 155 mm caliber is known as the SMArt 155. That known seeking fused munition has a nose fuse for an ejection unit which adjoins same at the rear end thereof and by means of which submunitions arranged in axially successive relationship in a casing are ejected at the rear end from the casing. The submunitions each have a respective anti-spin device and a rotational parachute as a descent-retarding device as well as sensors for target acquisition.

The design configuration of that known seeking fused munition with submunitions provided in a casing, wherein each submunition has at the front end a projectile-forming insert, is possible without any problem in the case of a SMArt 155, because of the relatively large diameter. In the case of a seeking fused munition of a smaller caliber however, when using the same design principle with a casing, the diameter of the projectile-forming insert would have to be correspondingly reduced. Such a reduction in the diameter of the projectile-forming insert however would result in a reduction in the piercing or penetration depth of the projectile formed from the insert.

SUMMARY OF THE INVENTION

In consideration of those factors the object of the invention is to provide a seeking fused munition of the kind set forth in the opening part of this specification which, even in the case of dimensioning with a relatively small caliber, is provided with an optimally effective projectile-forming insert.

The fact that the seeking fused munition according to the invention is of full caliber without a casing affords the advantage that the projectile-forming insert at the front end can be dimensioned with a relatively large diameter so that optimum projectile formation is possible after firing of the explosive charge associated with the projectile-forming insert, because the dimensioning of the insert is not limited, that is to say restricted, by a casing.

The seeking fused munition according to the invention has only a single projectile-forming insert. In accordance with the invention ejection of the submunition is not effected by means of a nose fuse—as in the case for example of SMArt 155—but by means of a base fuse which is arranged in the tail portion of the seeking fused munition and is associated with a desired-rupture portion which extends around the seeking fused munition and which is provided between the seeking fused munition and the tail portion.

As the seeking fused munition according to the invention does not involve the use of a nose fuse but a base fuse, it is also advantageously possible for the seeking fused munition to be provided at its front end with a ballistic cap, which is transmissive for radar beams of the sensor device. That ballistic cap preferably comprises a suitable plastic material and, after firing of the explosive charge associated with the projectile-forming insert, can be penetrated without any problem by the projectile-forming insert or the projectile formed from the insert.

In accordance with the invention the tail portion is preferably provided with a deployable guide mechanism, which is arranged in sub-caliber mode in the inactive condition of the seeking fused munition according to the invention. Such a design configuration means that it is advantageously possible for the seeking fused munition to be launched from barrels without rifling, like the barrels of combat tanks.

The seeking fused munition according to the invention can be for example of a 120 mm caliber. It will be appreciated that it can also be of another caliber.

BRIEF DESCRIPTION OF THE DRAWINGS

Further details, features and advantages will be apparent from the description hereinafter of an embodiment by way of example illustrated in the drawings, in which.

DETAILED DESCRIPTION OF THE INVENTION

Figure 1:
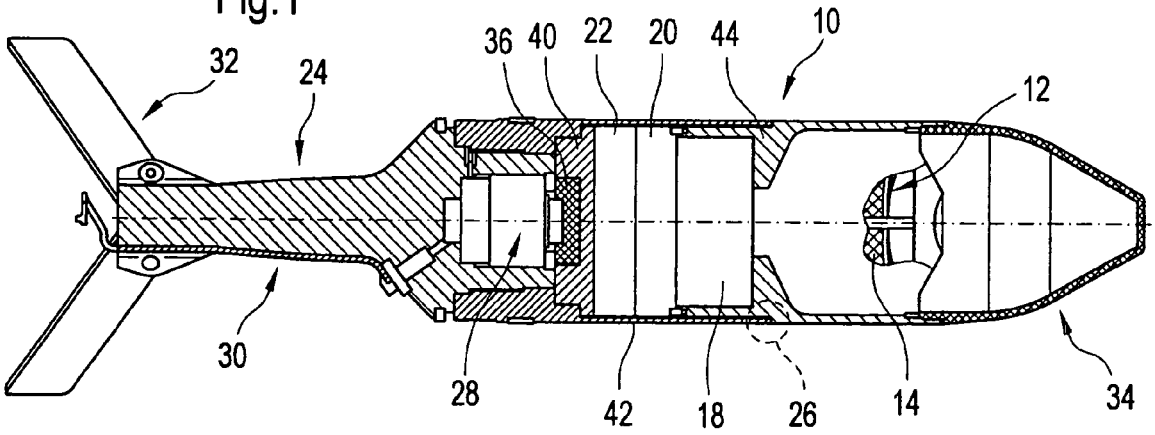
FIG. 1 shows a view in longitudinal section of a seeking fused munition.

FIG. 1 shows a configuration of the seeking fused munition 10, which has a projectile-forming insert 12 at the front end in a projectile or artillery-type shell 44. An explosive charge 14 for the projectile-forming insert 12 adjoins the insert 12 at the rear end thereof. A fuse device 16 is associated with the explosive charge 14. Operatively connected to the fuse device 16 is a sensor device 18 with which a target to be attacked is sensed.

The seeking fused munition 10 also has a spin device 20 and a braking device 22 for retarding the descent rate of the seeking fused munition 10. All those components are known for example from SMArt 155 so that there is no need for them to be described in detail; they are not subject-matter of the present invention. The subject-matter of the present invention is in particular that the seeking fused munition 10 is of a full-caliber structure without its own casing so that the projectile-forming insert can be dimensioned with a suitably large diameter.

The tail portion 24 has an ejection tube 42. It is connected to the seeking fused munition 10 along a peripherally extending desired-rupture portion 26 with a housing. The desired-rupture portion 26 can be separated by means of a base fuse 28 provided in the tail portion 24, with ejection charge 36, for separating the seeking fused munition 10 from the tail portion 24.

The desired-rupture portion 26 is of a gas-tight configuration and is launch-resistant. It is either in the form of a screwthreaded connection or a welded connection. It can also comprise a joining element of plastic material.

The base fuse 28 is connected to a connection cable 30 in order to be able to suitably program the base fuse 28. Another possibility involves inductively programming the base fuse 28.

The base fuse 28 fires both the ejection charge 36 and by way of a cable (not shown) starts the timing function of the sensor and fuse arrangement 16, 18.

The base 40 is fixedly connected to a cover 50 of the braking device 22.

Pyrotechnically fireable separating screws 48, 46 activate the braking device 22 and—later in time—the spin device 20.

The tail portion 24 has a deployable guide mechanism 32 which is shown in the deployed active condition in FIG. 1. In the inactive condition the fins of the guide mechanism 32 bear against the tail portion 24 in a sub-caliber relationship.

At the front end the seeking fused munition 10 has a ballistic cap 34 of a suitable plastic material which is transmissive for radar beams of the sensor device 18.

DESCRIPTION OF THE FUNCTION

After the seeking fused munition 10 is launched from a barrel the guide mechanism 32 is deployed by centrifugal forces or by spring force.

Figure 2:
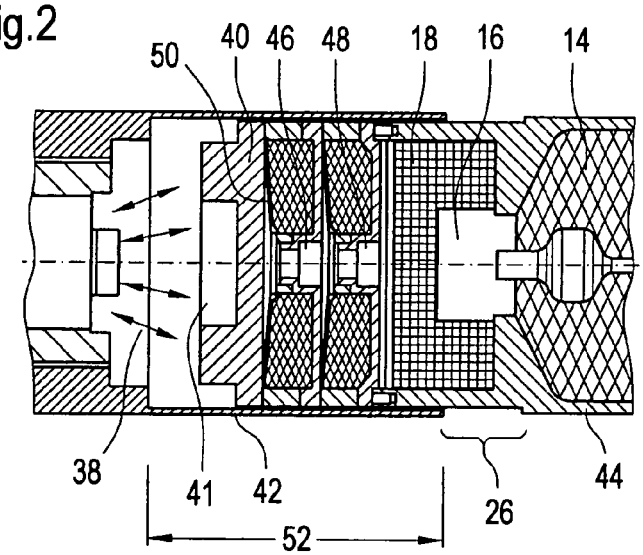
FIG. 2 shows the munition of FIG. 1 during ejection.
Figure 3:
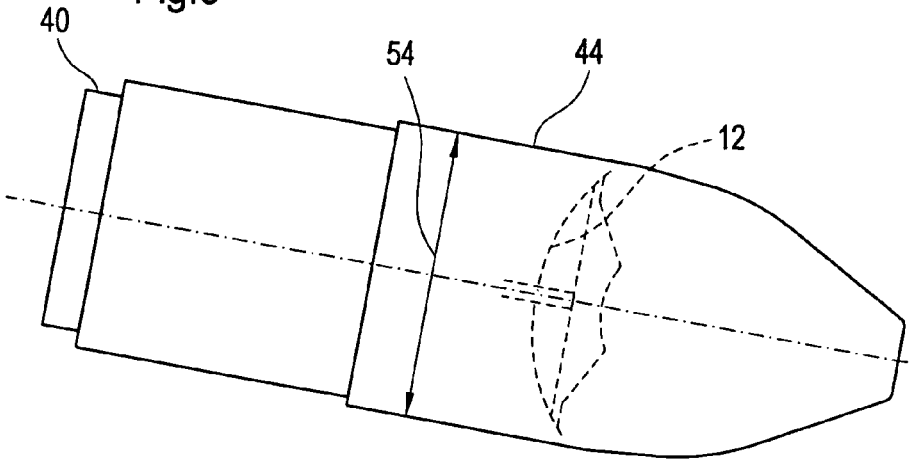
FIG. 3 shows the ejected munition.

Ejection of the shell 44 takes place on the trajectory just before the target (see FIG. 2). For that purpose the base fuse 28 fires the ejection charge 36. The gas pressure thereof leads to separation of the desired-rupture location 26 and ejection of the shell 44 from the ejection tube 42.

After firing of the separating screw 46 the braking device 22 is ejected. In that situation the cover 50 is removed with the base 40 in the axial direction.

The spin device 20 is then activated by firing of the separating screw 48.

After sensing of the target firing of the explosive charge 14 takes place at the optimized distance, with the insert 12 being converted into a target-attacking projectile.

The guide length 52 of the shell 44 in the launch tube 42 corresponds to 1.1 times the shell caliber 54. That ensures moment-free ejection of the shell 44 and separation of the shell 44 from the tail portion 24.

The base 40 contributes to the stable flight position of the shell 44 after separation.

List of References

10 seeking fused munition
12 projectile-forming insert (of 10)
14 explosive charge (for 12)
16 firing device (for 14)
18 sensor device (of 10 for 16)
20 spin device (of 10)
22 braking device (of 10)
24 tail portion (of 10)
26 desired-rupture portion (between 24 and 10)
28 base fuse (in 24 for 26)
30 connection cable (for 28)
32 guide mechanism (of 24)
34 ballistic cap (of 10)
36 ejection charge
38 gas pressure
40 base
41 recess
42 launch tube
44 shell
46 separating screw
48 separating screw
50 cover
52 guide length
54 shell caliber

What is claimed is:

1. A seeking fused munition comprising an artillery-like shell (44) at a front end thereof, a projectile-forming insert (12), a fuse device (16) for initiating an explosive charge (14), and a sensor device (18) for sensing a target which is to be attacked being housed in said shell; the shell 44 of the seeking fused munition (10) being of a full-caliber configuration (54), a rear end of said shell (44) being connected to a tail portion (24) of the seeking fused munition (10) along a peripherally extending specified rupture portion (26), said shell (44) being separable from the tail portion (24) by a base fuse (28) which is provided in the tail portion (24), the tail portion (24) having an ejection tube (42), the shell (44) having the rear end thereof supported in said ejection tube (42) for transport and for ejection, said shell (44) possessing a guide length (52) which extends into said ejection tube (42) to form an overlap between the ejection tube (42) and the rear end of said shell (44) of a length which is approximately equal to the caliber (54) of the shell, and wherein an ejection charge (36) is arranged in a recess (41) formed in a base (40) of the shell (44) and is fireable by the base fuse (28), the base fuse (28) being an integral component of the tail portion (24).

2. A seeking fused munition according to claim 1, wherein a ballistic cap (34) which is transmissive for radar beams is provided at the front end of the munition.

3. A seeking fused munition according to claim 1, wherein the tail portion (24) includes a deployable guide mechanism (32).

4. A seeking fused munition according to claim 1, wherein said shell (44) is separable from the tail portion (24) of said seeking fused munition (10).

5. A seeking fused munition according to claim 1, wherein the base (40) is connected to a cover (50) of a braking device (22), and the braking device (22) forms a tail-end portion of the shell (44).

* * * * *